United States Patent [19]

Kubisch et al.

[11] Patent Number: 5,062,467

[45] Date of Patent: Nov. 5, 1991

[54] VACUUM COUNTERGRAVITY CASTING APPARATUS AND METHOD

[75] Inventors: John G. Kubisch, Midland; Paul D. Wilczynski, Bay City, both of Mich.

[73] Assignee: General Motors Corporation, Detroit, Mich.

[21] Appl. No.: 698,140

[22] Filed: May 10, 1991

[51] Int. Cl.[5] ..... B22C 9/02; B22C 9/04; B22D 18/06

[52] U.S. Cl. ..... 164/7.1; 164/34; 164/63; 164/255

[58] Field of Search ..... 164/7.1, 34, 35, 36, 164/63, 119, 255, 306, 137

[56] References Cited

U.S. PATENT DOCUMENTS

| | | | |
|---|---|---|---|
| 4,085,790 | 4/1978 | Wittmoser | 164/7.1 |
| 4,340,108 | 7/1982 | Chandley et al. | 164/63 |
| 4,606,396 | 8/1986 | Chandley et al. | 164/255 |
| 4,616,691 | 10/1986 | Voss | 164/255 |
| 4,658,880 | 4/1987 | Voss | 164/63 X |
| 4,745,962 | 5/1988 | Mercer et al. | 164/255 |
| 4,787,434 | 11/1988 | Cleary et al. | 164/34 |
| 4,828,011 | 5/1989 | Hafer et al. | 164/255 |
| 4,848,439 | 7/1989 | Plant | 164/16 |
| 4,874,029 | 10/1989 | Chandley | 164/34 |
| 4,932,461 | 6/1990 | Schaffer et al. | 164/255 |
| 4,957,153 | 9/1990 | Chandley | 164/7.1 |
| 4,971,131 | 11/1990 | Aubin et al. | 164/7.1 |

*Primary Examiner*—J. Reed Batten, Jr.

*Attorney, Agent, or Firm*—Reising, Ethington, Barnard, Perry & Milton

[57] ABSTRACT

Vacuum countergravity casting apparatus and process employ a container having a peripheral wall defining an open bottom chamber that receives one or more molds or destructible patterns. A first inherently unstable mass of particulates (e.g., binderless sand) is disposed in the chamber about the molds/patterns and a second supportive mass of bonded particulates (e.g., resin-bonded sand) is disposed in the chamber about the molds/patterns beneath the first mass. The second supportive mass is strong enough to support the first mass and preferably the molds/patterns as well as castings ultimately formed as necessary during the casting operation in the event of intentional or unexpected interruption of a negative differential pressure established between the inside and outside of the container.

35 Claims, 3 Drawing Sheets

VACUUM COUNTERGRAVITY CASTING APPARATUS AND METHOD

FIELD OF THE INVENTION

The present invention relates to the vacuum-assisted countergravity casting of a melt into a mold cavity formed by a casting mold or destructible pattern in a particulate mass held in an open bottom container by a negative differential pressure between the inside and outside thereof and, more particularly, to means for eliminating the need to maintain the negative differential pressure throughout the casting operation.

BACKGROUND OF THE INVENTION

A vacuum-assisted countergravity casting process using a gas permeable, self-supporting mold sealingly received in a vacuum chamber is described in such patents as the Chandley et al. U.S. Pat. Nos. 4,340,108 and 4,606,396. That countergravity casting process involves providing a mold having a porous, gas permeable upper mold member (cope) and a lower mold member (drag) sealingly engaged together at a parting plane, sealing the mouth of a vacuum housing to a surface of the mold such that a vacuum chamber formed in the housing confronts the gas permeable cope, immersing the bottom side of the drag in an underlying pool of melt, and evacuating the vacuum chamber to draw the melt upwardly through one or more ingate passages in the drag into one or more mold cavities formed between the cope and the drag.

Recent improvements in the vacuum-assisted countergravity casting process, represented by the Chandley U.S. Pat. Nos. 4,874,029 and 4,957,153 and the Aubin et al. U.S. Pat. No. 4,971,131 of common assignee herewith, have achieved substantial increases in the productivity and economies of the process. In these improved casting processes, mold cavity-forming means, such as one or more gas permeable molds (e.g., resin-bonded sand molds) or destructible patterns (e.g., polystyrene patterns) are surrounded in a mass of particulate mold material (e.g., binderless foundry sand) held within the open bottom container by establishment of a suitable negative differential pressure between the inside and the outside thereof. The particulate mass and molds/patterns are held in the container such that lower melt inlets of the molds/patterns are exposed at the open bottom end of the container for immersion in an underlying melt pool. The negative differential pressure between the inside and outside of the container is effective to draw the melt upwardly into the mold cavities as formed by the molds or patterns in the particulate mass. After the melt has solidified and the melt-filled container is moved to an unload station, the negative differential pressure is released to permit gravity-assisted discharge of the particulate mass, castings, and molds, if used, through the open bottom of the container.

While the aforementioned improved countergravity casting processes are preferably practiced using unbonded (i.e., binderless) particulates held within the container by the negative differential pressure, the processes may also be practiced using weakly bonded particulates in the manner taught in the Plant U.S. Pat. No. 4,848,439 wherein the particulates are bonded in-situ in the container by passing a gas/vapor curing agent through binder-coated particulates after they are introduced in the container about the mold cavity-forming means.

In practicing the aforementioned improved countergravity casting processes, the negative differential pressure is maintained between the inside and the outside of the container throughout the casting operation to hold the particulates about the molds/patterns in the container. Only when the melt-filled container is located at the demold station is the negative differential pressure released to allow the particulates, castings, and molds, if used, to discharge by gravity through the open bottom end of the container.

In view of the continuing desire for improvements in these vacuum-assisted countergravity casting processes, the provision of some means to hold the contents of the container from discharge through the open bottom end in the event of an interruption in the negative differential pressure would be welcomed. For example, such means would be welcomed as a way to avoid unexpected discharge of the container contents that might otherwise occur if the negative differential pressure is interrupted unexpectedly during the casting operation; e.g., as a result of malfunction of the vacuum pump evacuating the container. Moreover, such means would be welcomed as a way to impart flexibility to the process in that establishment of the negative differential pressure could be intentionally delayed/interrupted during the casting operation to achieve certain benefits. For example, establishment of the negative differential pressure could be delayed until after the mold and melt are engaged so as to avoid drawing any impurities, debris, and other foreign matter floating on the melt into the mold.

It is an object of the present invention to provide an improved countergravity casting apparatus and process of the type using a particulate mass held about mold cavity and inlet-forming means (e.g., one or more molds/patterns) in an open bottom container wherein the need to maintain a negative differential pressure between the inside and the outside of the container throughout the casting operation to hold particulates in the container is eliminated such that an unexpected interruption in the negative differential pressure will not result in discharge of the container contents during the casting operation.

It is another object of the present invention to provide an improved countergravity casting apparatus and process of the type using a particulate mass held about mold cavity and inlet-forming means in an open bottom container wherein the need to maintain a negative differential pressure between the inside and outside of the container throughout the casting operation to hold the particulates therein is eliminated such that establishment of the negative differential pressure can be intentionally delayed/interrupted during the casting operation to achieve certain process/product improvements.

It is another object of the invention to provide an improved countergravity casting apparatus and process of the type using a particulate mass held about a mold cavity and inlet-forming means in an open bottom container wherein the need to maintain a negative differential pressure between the inside and outside of the container throughout the casting operation is eliminated by providing a particulate mass which comprises a first portion of inherently unstable particulates (e.g., binderless particulates) disposed in the container about the mold cavity and inlet-forming means and a second supportive portion of bonded particulates disposed about the mold cavity and inlet-forming means beneath the first, inherently unstable portion for supporting the first portion and, if desired, the mold cavity and inlet-forming means as well as castings in the container during the casting operation, as may be necessary in the event of an intentional or unexpected interruption of the aforementioned negative differential pressure.

SUMMARY OF THE INVENTION

The invention contemplates an improved countergravity casting apparatus and process wherein a container includes a peripheral wall defining an open bottom chamber for receiving mold cavity and inlet-forming means, such as one or more molds or destructible patterns. A first inherently unstable mass of particulates (e.g., binderless particulates) is disposed in the container about the mold cavity and inlet-forming means. A second supportive mass of bonded particulates (e.g., resin-bonded particulates) is disposed in the container about the mold cavity and inlet-forming means beneath the first mass for supporting the first mass and preferably also the mold cavity and inlet-forming means as well as castings formed in the container as necessary during the casting operation to accommodate intentional or unexpected interruption in the negative differential pressure established between the inside and outside of the container.

In one embodiment of the invention, the first inherently unstable mass comprises substantially binderless foundry sand while the second supportive mass comprises resin-bonded foundry sand.

In another embodiment of the invention, the peripheral wall of the container includes interlocking means, such as a protuberance or recess, for engaging the second supportive mass. The mold cavity and inlet-forming means (e.g., molds/patterns) may also include similar interlocking means for engaging the second supportive mass. In this way, the second supportive mass of bonded particulates is interlocked between the container and the mold cavity and inlet-forming means for supporting the first inherently unstable mass of particulates as well as the mold cavity and inlet-forming means and castings formed therein in the container as necessary during the casting operation to accommodate intentional or accidental interruption of the negative differential pressure between the inside and outside of the container.

In still another embodiment of the invention, the first mass of particulates and the mold cavity and inlet-forming means are supported in the container by the second supportive mass so that establishment of the negative differential pressure can be delayed until after the mold cavity and inlet-forming means and melt are engaged. Once the mold cavity-forming means and the melt source are engaged, a negative differential pressure between the inside and outside of the container is established at a sufficient level to draw the melt upwardly into the mold cavity. Establishment of the negative differential pressure after such engagement avoids drawing impurities, debris, and other foreign matter which may be floating on the melt source into the mold cavity, thereby yielding cleaner castings.

DESCRIPTION OF THE DRAWINGS

The objects and advantages of the present invention enumerated above will become more readily apparent from the following detailed description and drawings.

DETAILED DESCRIPTION OF THE INVENTION

Figure 1:
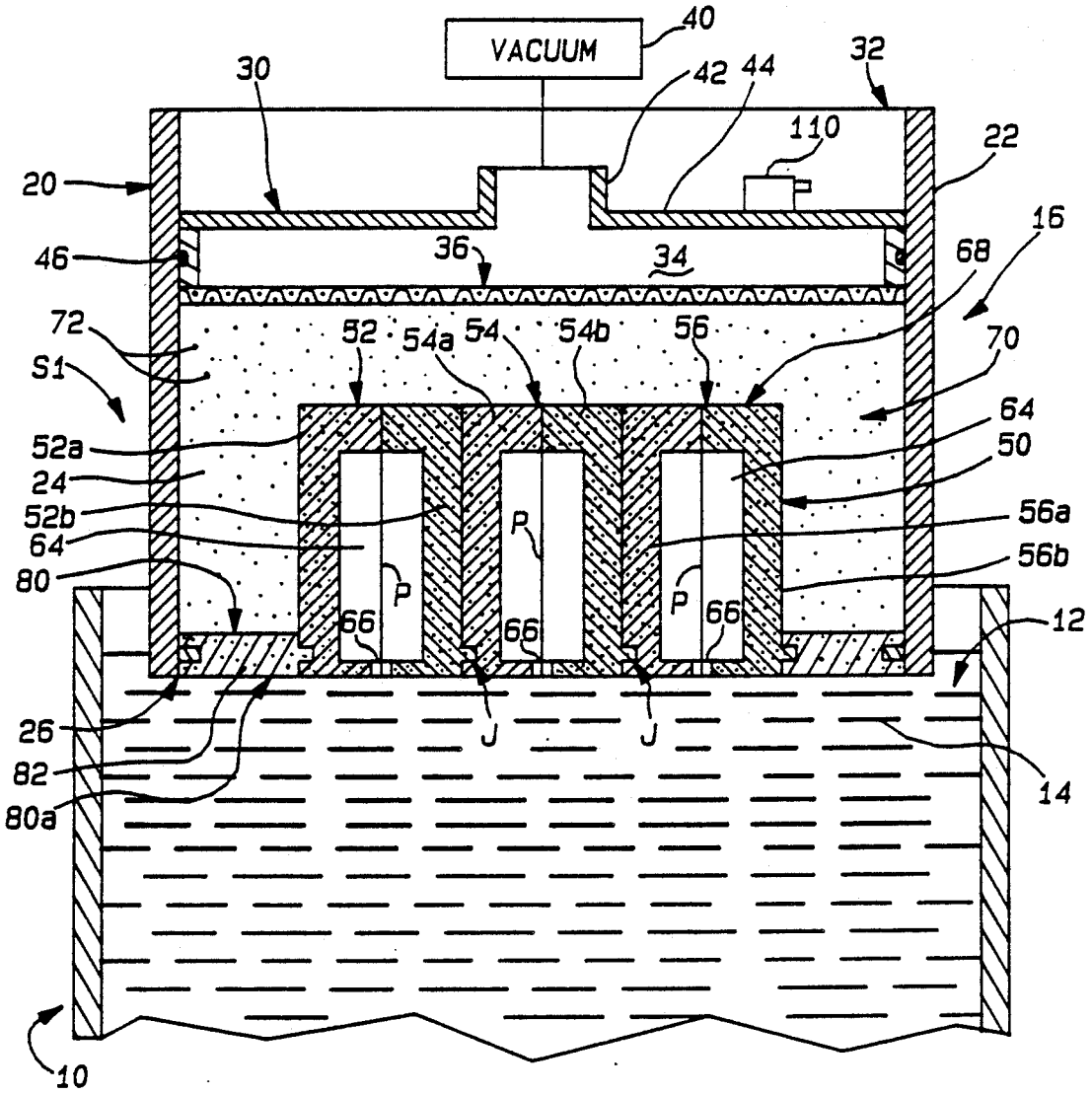
FIG. 1 is a side sectional view of a casting apparatus in accordance with one embodiment of the invention positioned at a casting station.

FIG. 1 illustrates a countergravity casting station S1 wherein a vessel 10 (e.g., a crucible) contains a pool 12 of the melt 14 (e.g., molten metal) to be drawn upwardly into a casting apparatus 16 in accordance with one embodiment of the invention. The casting apparatus 16 includes a container 20 having a peripheral wall 22 defining a chamber 24 having an open bottom end 26. The container 20 has a vacuum head or bell 30 received sealingly in the open upper end 32 thereof. The vacuum head 30 defines a vacuum chamber 34 that is communicated to the chamber 24 by a gas permeable, particulate impermeable wall 36, such as an apertured screen or a porous ceramic or metal member. The vacuum chamber 34 is also communicated to a source of vacuum 40 (e.g., a vacuum pump) by a conduit 42 sealingly fastened on an upper gas impermeable wall 44 so that a negative differential pressure can be established between the inside and outside of the container 20 as desired during the casting process. The vacuum head 30 includes one or more peripheral seals 46 (one shown) for sealingly engaging the peripheral wall 22 when the vacuum head is assembled within the container 20.

Disposed in the container 20 is mold cavity and inlet-forming means 50 illustrated in FIGS. 1–5 as comprising a plurality of gas permeable, self-supporting molds 52,54,56 stacked side-by-side and interconnected by tongue and groove joints J therebetween to form a mold stack 68. Each mold includes first and second mold members **52*a*,52*b*; 54*a*,54*b*;56*a*;56*b* sealingly engaged at vertical parting planes P therebetween to form a mold cavity 64 and melt inlet 66** at each parting plane P.

The invention is not limited to vertically parted mold members and may be practiced using horizontally parted mold members as well as one-piece refractory or ceramic molds. Moreover, the invention may be practiced using mold cavity and inlet-forming means 50 that comprises one or more destructible patterns (not shown) of the type described in U.S. Pat. No. 4,874,029, the teachings of which are incorporated herein by reference.

A first inherently unstable mass 70 of loose, substantially binderless particulates 72 (e.g., dry foundry sand) and a second, supportive mass 80 of bonded particulates 82 (e.g., resin-bonded foundry sand) are disposed in the container 20 about the mold stack 68. The first mass 70 is inherently unstable in that it comprises a mass of unbonded or weakly bonded particulates 72 which, in the context of the present invention, has insufficient internal cohesive strength to, by itself, support its own weight and that of the mold stack 68 as well as that of the castings ultimately formed therein during the casting process.

The second supportive mass 80 is supportive in that it comprises a mass of resin-bonded particulates which, in the context of the present invention, has sufficient internal cohesive strength to support its own weight and that of the first mass 70 of particulates 72 without the need for establishment of a negative differential pressure between the inside and outside of the container 20. Preferably, the second supportive mass 80 exhibits sufficient strength to support its own weight, the weight of the first mass 70, the weight of the mold stack 68 and the weight of castings ultimately formed therein during the casting process, as necessary to accommodate the intentional or unexpected interruption of the negative differential pressure between the inside and outside of the container 20. However, the invention is not so limited and may be practiced using a suitable mold support mechanism (not shown) to support the mold stack 68 and the castings ultimately formed therein in the container 20 as taught, for example, in U.S. Pat. No. 4,957,153, the teachings of which are incorporated to this end. If destructible patterns (not shown) are used in lieu of mold stack 68 to provide mold cavity and inlet-forming means 50 in the particulate masses 70,80, the patterns may be supported in the container by a pattern support mechanism as taught, for example, in aforementioned U.S. Pat. No. 4,874,029.

The mold members **52*a*,52*b*;54*a*,54*b*;56*a*;56*b* can be made of resin-bonded sand in accordance with known practice wherein a mixture of sand or equivalent refractory particulates and a binder material is formed to shape and cured or hardened against contoured metal pattern plates (not shown) having the desired complementary contour or profile to form the parting surfaces with portions of the mold cavities 64 and the melt inlets 66** as well a the tongue and groove joints J. The bonding material may comprise inorganic or organic thermal or chemical setting plastic resin or equivalent bonding material. The bonding material is usually present in a minor percentage of the mixture, such as about 5% by weight or less of the mixture.

The mold stack 68 is assembled by stacking the mold members **52*a*,52*b*;54*a*,54*b*;56*a*,56*b* in side-by-side relation at the parting planes P. The mold members are temporarily held sealingly engaged at the parting planes P, sans glue, by suitable fixturing means, such as an exterior clamp about the mold stack, a sheet or strap wrapped about the mold stack, bolts through the mold members (not shown) in accordance with aforementioned U.S. Pat. No. 4,957,153. The fixturing means may remain with the mold stack 68** throughout the casting process, if desired.

Figure 2:
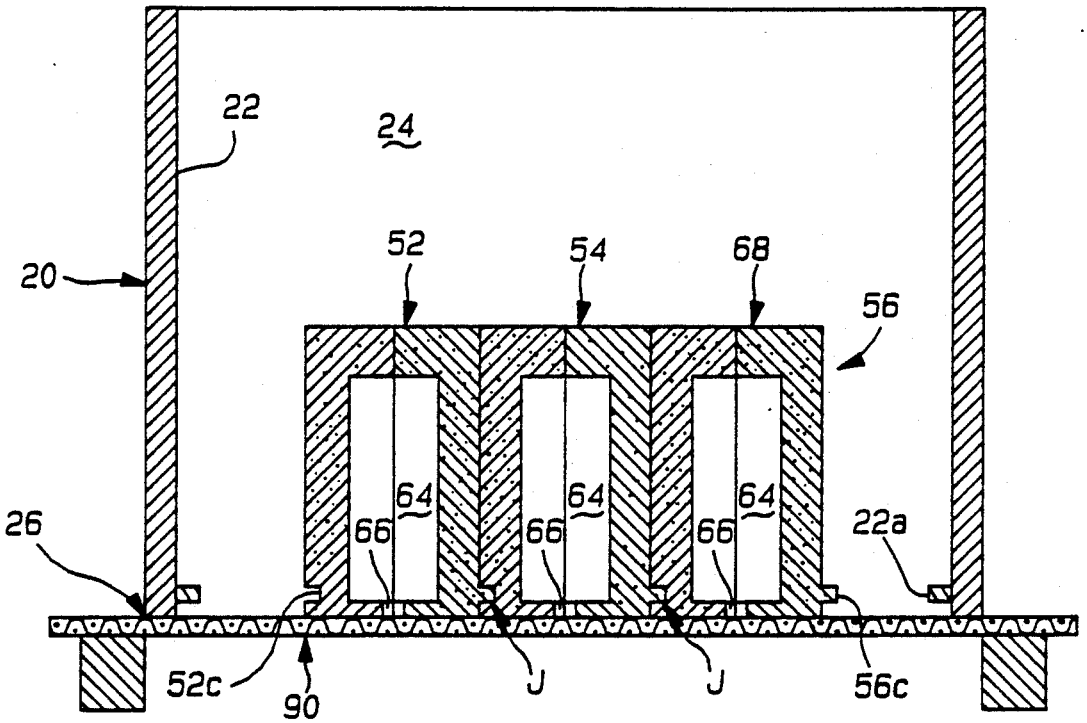
FIG. 2 is a side sectional view illustrating the container positioned about a plurality of gas permeable molds forming a mold stack.
Figure 3:
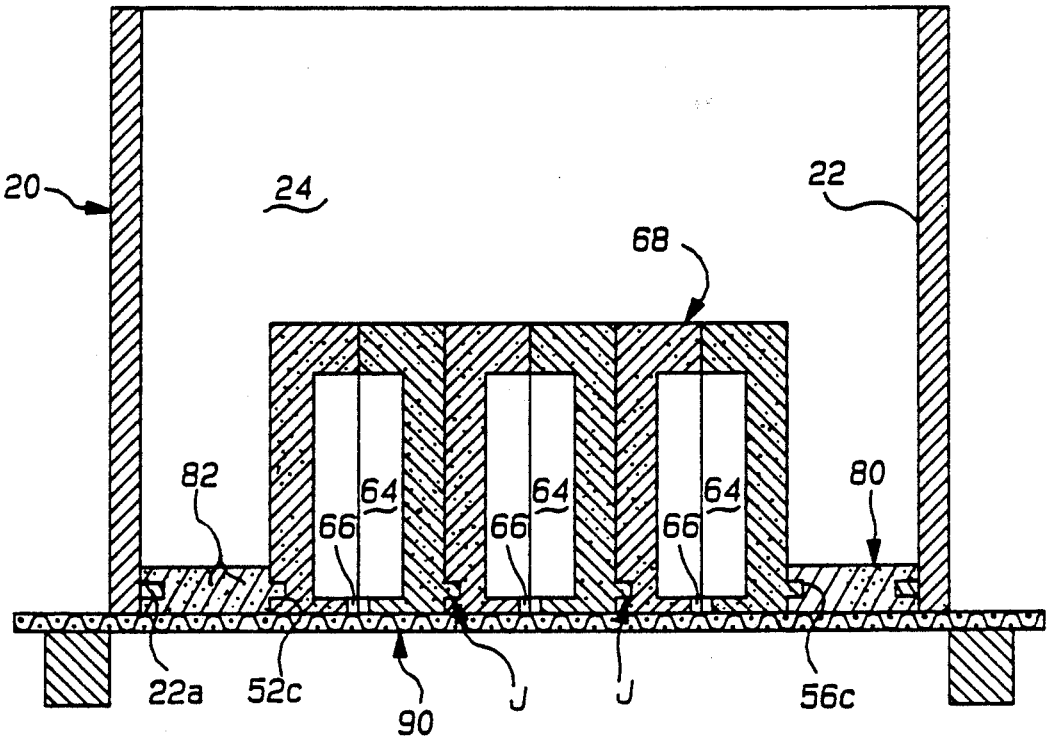
FIG. 3 is a side sectional view illustrating bondable particulates, such as resin-coated sand, disposed in the container about the mold stack.

As shown in FIG. 2, the assembled mold stack 68 is placed on an apertured screen 90. The peripheral wall 22 of the container 20 is then lowered onto the screen 90 about the mold stack 68 until the open bottom end 26 rests on the screen. A quantity of resin-coated particulates 82; e.g., foundry sand coated with an air setting ("no bake") plastic resin, is then introduced between the mold stack 68 and the peripheral wall 22 to a predetermined depth to form a initial bondable particulate mass 80 between the peripheral wall 22 and the mold stack 68 as shown in FIG. 3. The screen 90 can be vibrated during or after the particulates 82 are introduced to insure tight packing about the mold stack 68. As shown in the Figures, the peripheral wall 22 includes a peripheral protuberance **22*a* for engaging the bondable mass 80 and the mold stack 68 includes the outboard molds 52,56 having a recess 52*a* and protuberance 56*c*, respectively, for engaging the particulate mass 80**.

Figure 4:
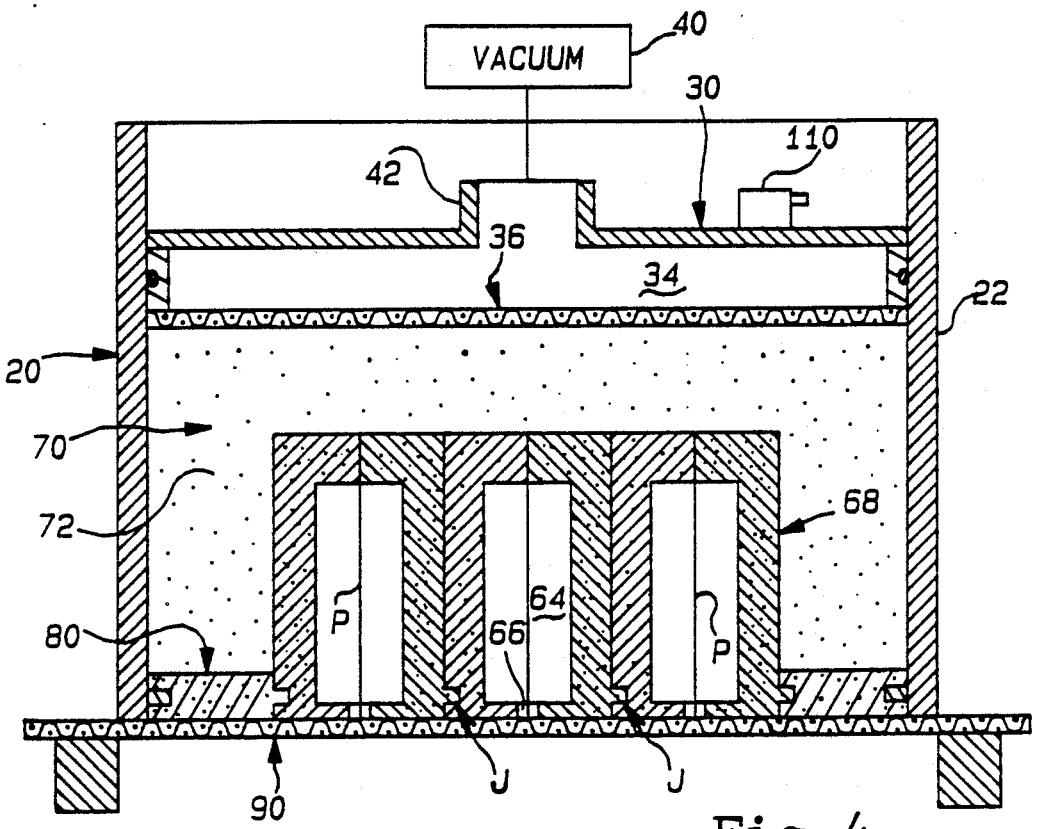
FIG. 4 is a side sectional view illustrating the first inherently unstable mass of particulates and a vacuum head disposed in the container above the bondable particulate mass.

Following introduction of the particulates 82, the loose, substantially binderless particulates 72 (e.g., loose, dry foundry sand) are introduced between the mold stack 68 and the peripheral wall 22 to a selected depth above the mold stack 68 to form the inherently unstable mass 70 as shown in FIG. 4. The vacuum head 30 is then sealingly positioned in the container 20 on the inherently unstable mass 70 as shown with the gas permeable, particulate impermeable member 36 engaging the mass 70. The screen 90 may be vibrated during or after filling with the particulates 72 to tightly pack them about the mold stack 68.

Thereafter, the resin-coated particulates 82 are air set at ambient temperature for a sufficient time to bond the resin coated particulates 82 into the supportive bonded mass 80 which is interlocked between the peripheral wall 22 and the mold stack 68 by engagement with the protuberance 22 and the recess **52*c*/protuberance 56*c*. Air setting of the coated particulates 82 can be hastened, if desired, by actuating the vacuum source 40 to evacuate the chamber 34 and thus the inside of the container 20 so as to draw ambient air through the particulate masses 70,80 to effect more rapid air setting of the resin coated particulates 82**. The invention is not limited to air setting ("no bake") resin binder systems and may be practiced using other chemical or thermal curing/setting binder systems (e.g., see U.S. Pat. No. 4,874,029).

In the embodiment described above, the supportive mass 80 of bonded particulates 82 is strong enough to support the particulate mass 70, the mold stack 68 and the castings formed therein in the container 20 during the casting process without the need for a negative differential pressure established between the inside and outside of the container. For example, the supportive mass 80 will support the mold stack 68, mass 70, and castings in the container 20 when ambient pressure is present therein. The strength of the supportive mass 80 can be controlled to this end by appropriate selection of the thickness of the mass 80, the width (span) of the mass 80 between the peripheral wall 22 and the mold stack 68, the mesh size of the particulates 82, the type of resin binder used, and the extent of curing/setting of the resin coated particulates 82. For illustrative purposes only, a supportive mass 80 comprising approximately 47 pounds of fully bonded silica sand (75 mesh AFS particle size coated with ALPHASET® phenolic resin/-ester air setting binder available from Borden Chemical Co.) and having a thickness of approximately 4 inches and width between the peripheral wall 22 and the mold stack 68 of approximately 4 inches has been used in countergravity casting a resin-bonded sand test mold stack 68. The mold stack 68 weighed approximately 54 pounds while the loose, binderless sand mass 70 weighed approximately 335 pounds. Castings of approximately 10 pounds were formed in the mold stack 18. The supportive mass 80 supported the aforementioned components/castings in the container 20 without the need for any negative differential pressure between the inside and outside thereof. The bonded mass 80 was interlocked between the peripheral wall 22 and the mold stack 68 in the manner illustrated in the Figures.

Figure 5:
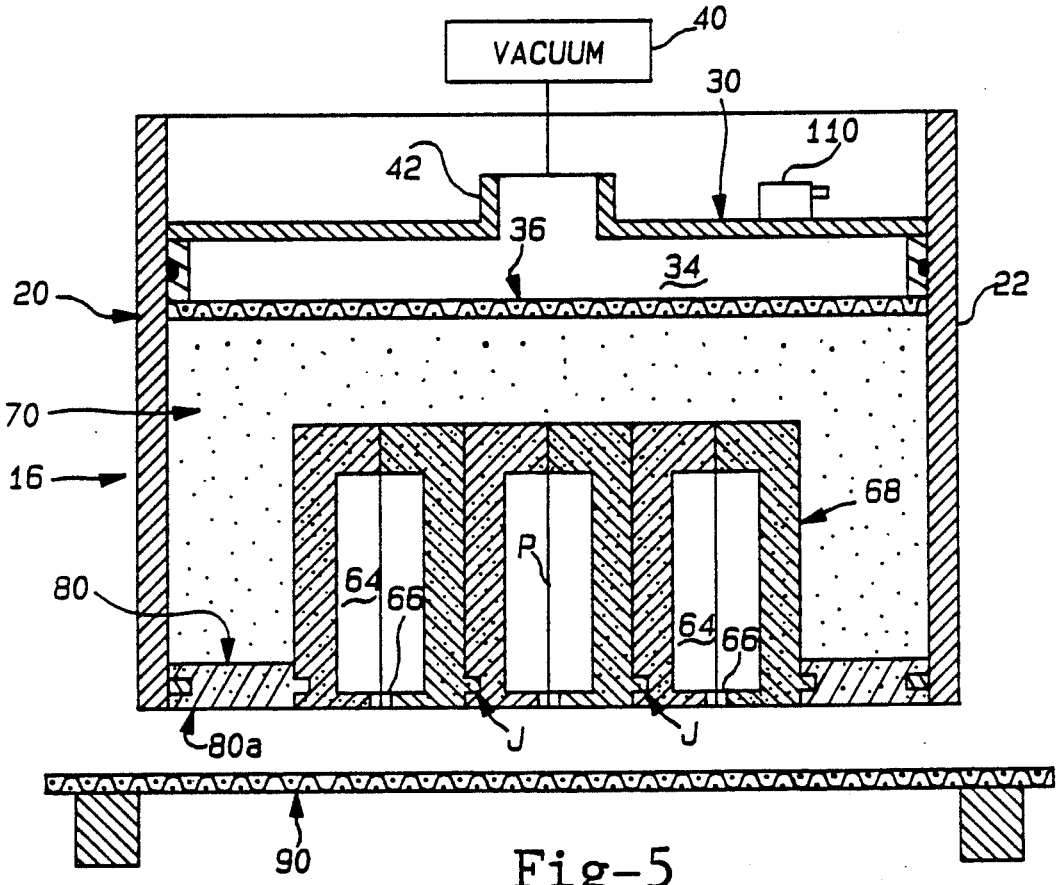
FIG. 5 is a side sectional view illustrating the assembled container/particulates/mold stack after in-situ bonding of the bondable particulate mass in the container.

After air setting of the particulates 82, the assembled casting apparatus 16 is raised away from the screen 90, FIG. 5, for transport to the casting station S1, FIG. 1. The casting apparatus 16 is raised and transported by a manipulating arm (not shown) fastened to the container 20 as shown in U.S. Pat. No. 4,340,108, the teachings of which are incorporated herein by reference.

The casting apparatus 16 may be raised from the screen 90 with or without the vacuum source 40 being actuated to evacuate the chamber 34 and establish a negative differential pressure between the inside and outside of the container 20 since the supportive mass 80 of bonded particulates 82 is strong enough to solely support the inherently unstable mass 70 and the mold stack 68 in the container.

In accordance with a method aspect of the invention, the casting apparatus 16 is positioned above the pool 12 of melt 14 with the inside of the container 20 communicated to ambient pressure via a bleeder valve 110; i.e., the vacuum source 40 is not actuated. The apparatus 16 is then lowered to immerse (engage) the bottom 80*a* of the supportive mass 80 and the melt inlets 66 in the melt 14. At this point, the bleeder valve 110 is closed to the ambient atmosphere, and the vacuum source 40 is actuated to evacuate the vacuum chamber 34 and thus the inside of the container 20 to establish a sufficient negative differential pressure between the mold cavity 64 and the pool 12 to draw the melt 14 upwardly from the pool through the inlets 66 into the mold cavities 64 to fill the mold cavities 66 with the melt. Establishment of the negative differential pressure after the melt inlets 66 are immersed in the pool 12 is advantageous to prevent impurities, debris, and other foreign matter which may be floating on the melt surface from being drawn into the mold cavities 64. Cleaner melt will be drawn into the mold cavities and thus cleaner castings will ultimately be produced as a result. However, the invention is not so limited and may be practiced with the vacuum source 40 actuated as the casting apparatus 16 is lifted from the screen 90 and/or is being immersed in the pool 12.

After solidification of the melt 14 in at least the melt inlets 66, the casting apparatus 16 is raised away from the pool 12 to withdraw the supportive mass 80 and the melt inlets 66 from engagement with the melt 14. At this point, the vacuum source 40 may be deactuated since the supportive mass 80 is strong enough to support the inherently unstable mass 70 and mold stack 68 as well as melt/castings residing therein in the container 20. Preferably, the negative differential pressure is maintained in the container 20 so as to aid in holding the mass 70 and melt-filled mold stack 68 in the container 20.

The casting apparatus 16 is then transported to a demold station (not shown) where the negative differential pressure, if maintained, is released by opening the bleeder valve 110 to ambient atmosphere. The vacuum head 30 is removed from the container 20, and then the container 20 is lifted from the particulate masses 70,80, mold stack 68, and castings therein.

As is apparent, the present invention is advantageous in that the need to maintain the negative differential pressure between the inside and outside of the container 20 throughout the entire casting process is eliminated. In particular, the negative differential pressure does not have to be established prior to immersion of the mold melt inlets 66 in the melt 14 as with the practice of the process of U.S. Pat. Nos. 4,874,029 and 4,957,153 and, instead, is required only after immersion to effect countergravity casting of the melt 14 into the mold cavities 64. The capability to delay establishment of the negative differential pressure until after immersion of the melt inlets 66 in the melt 14 permits production of cleaner castings as explained above. Moreover, in the event of an unexpected interruption in the negative differential pressure during the casting process, the supportive mass 80 of bonded particulates 82 functions as necessary to prevent discharge of the container contents; i.e., the particulate masses 70,80, mold stack 68, and melt/castings therein, through the open bottom end of the container 20.

While the invention has been described in terms of specific embodiments thereof, it is not intended to be limited thereto but rather only to the extent set forth hereafter in the following claims.

We claim:

1. Apparatus for countergravity casting of a melt, comprising:

a) a container having a peripheral wall defining a chamber having an open bottom end, b) means disposed in the chamber for forming a mold cavity and melt inlet for communicating the mold cavity with an underlying source of the melt, c) a first inherently unstable mass of particulates disposed in the chamber about the mold cavity and inlet-forming means, and d) a second supportive mass of bonded particulates disposed in the container about the mold cavity and inlet-forming means beneath said first mass for supporting said first mass in the chamber as the container and source are relatively moved toward/away from one another for communicating/discommunicating said mold cavity and said source, as appropriate, for casting.

2. The apparatus of claim 1 wherein the first mass comprises substantially binderless sand.

3. The apparatus of claim 1 wherein the second mass comprises resin-bonded sand.

4. The apparatus of claim 1 wherein the second supportive mass supports said first mass and said mold cavity and inlet-forming means as well as castings formed thereby, as necessary, in the container as the container and the source are relatively moved toward/away from one another.

5. The apparatus of claim 4 wherein said second supportive mass is interlocked between said peripheral wall and said mold cavity and inlet-forming means.

6. Apparatus for countergravity casting of a melt, comprising:

a) a container having a peripheral wall defining a chamber having an open bottom end, b) a gas permeable mold disposed in the chamber, said mold including a mold cavity and a melt inlet communicating the mold cavity with an underlying source of the melt, c) a first inherently unstable mass of particulates disposed about the mold in the chamber, and d) a second supportive mass of bonded particulates disposed about the mold in the container beneath said first mass for supporting said second mass in the chamber as the container and source are relatively moved toward/away from one another to engage/disengage said melt inlet and said source, as appropriate, for casting.

7. The apparatus of claim 6 wherein the mold comprises a bonded particulate mold.

8. The apparatus of claim 7 wherein the mold comprises a resin-bonded sand mold.

9. The apparatus of claim 6 wherein the first mass comprises substantially binderless sand.

10. The apparatus of claim 6 wherein the second mass comprises resin-bonded sand.

11. The apparatus of claim 10 wherein the resin-bonded sand is cured in-situ in the container.

12. Apparatus for countergravity casting of a melt, comprising:

a) a container having a peripheral wall defining a chamber having an open bottom end, b) a gas permeable mold disposed in the chamber, said mold including a mold cavity and a melt inlet for communicating the mold cavity with an underlying source of the melt, c) a first inherently unstable mass of particulates disposed about the mold in the chamber remote from said open bottom end, and d) a second supportive mass of bonded particulates disposed about the mold in the chamber beneath said first mass for supporting said mold and said first mass, as necessary, in the chamber as the container and the source are relatively moved toward-/away from one another to engage/disengage said melt inlet and said source for casting.

13. The apparatus of claim 12 wherein the mold comprises a bonded particulate mold.

14. The apparatus of claim 13 wherein the mold comprises a resin-bonded sand mold.

15. The apparatus of claim 12 wherein the first mass comprises substantially binderless sand 16. The apparatus of claim 12 wherein the second mass comprises resin-bonded sand.

17. The apparatus of claim 16 wherein the resin-bonded sand is cured in-situ in the container.

18. The apparatus of claim 12 wherein said peripheral wall includes means for interlocking with said second mass.

19. The apparatus of claim 18 wherein said interlocking means comprises a protuberance on the peripheral wall for engaging said second mass.

20. The apparatus of claim 12 wherein the mold includes means for interlocking with said second mass.

21. The apparatus of claim 20 wherein said interlocking means comprises a recess on the mold wall for receiving said second mass.

22. The apparatus of claim 21 wherein said interlocking means comprises a protuberance on the mold for engaging said second mass.

23. The apparatus of claim 12 further comprising means for establishing a negative differential pressure between the mold cavity and the source when the melt inlet and the source are engaged sufficient to urge the melt upwardly from the source into the mold cavity.

24. A method of countergravity casting a melt, comprising the steps of:

a) disposing a container about means for forming a mold cavity and a melt inlet beneath said mold cavity such that an open bottom end of the container is disposed proximate the melt inlet, b) providing a first inherently unstable mass of particulates about the mold cavity and inlet-forming means in the container, c) providing a second mass of bonded particulates about the mold cavity and inlet-forming means in the container such that, when the container is oriented to position said melt inlet facing the underlying source of the melt, said first mass is disposed atop said second mass and is supported in the container by said second mass, d) relatively moving the container and the source to engage said melt inlet and said source, and e) drawing the melt upwardly toward the melt inlet into the mold cavity when said melt inlet and said source are engaged.

25. The method of claim 24 wherein in step e), a negative differential pressure is established between the mold cavity and the source when said melt inlet and said source are engaged to draw the melt upwardly into the mold cavity.

26. A method of countergravity casting a melt, comprising the steps of:

a) positioning a gas permeable casting mold in a container having an open end, said mold having a mold cavity and a melt inlet for communicating said mold cavity with an underlying source of the melt, b) providing a first inherently unstable mass of particulates about the mold in the container, c) providing a second mass of bonded particulates about the mold in the container such that, when the container is oriented to position said melt inlet facing the underlying source of the melt, said first mass is disposed atop said second mass and, as necessary, said second mass supports said first mass in the container, d) relatively moving the container and the source to engage said melt inlet and said source, and e) drawing the melt upwardly through the melt inlet into the mold cavity when said melt inlet and said source are engaged.

27. The method of claim 26 wherein the second mass is bonded in-situ in the container about the mold.

28. The method of claim 27 wherein said second mass is bonded in-situ in the container by disposing a binder/-particulates mixture comprising said second mass in the container about the mold proximate said open end and setting/curing the binder after said first mass is disposed in the container to bond the particulates of said mixture.

29. The method of claim 28 wherein the second mass is formed of resin-bonded sand.

30. The method of claim 26 wherein in step e), a negative differential pressure is established between the mold cavity and the source when said melt inlet and said source are engaged to draw the melt upwardly into the mold cavity.

31. The method of claim 26 wherein the second supportive mass supports the first mass and the mold in the container during step (d).

32. The method of claim 31 further including relatively moving the container and the source to disengage said melt inlet from said source after filling the mold cavity with said melt, including supporting the melt-filled mold and the first mass of particulates in the container by said second mass of bonded particulates.

33. The method of claim 26 including interlocking said second mass and said container.

34. The method of claim 33 including interlocking said second mass and said mold.

35. A method of countergravity casting a melt, comprising the steps of:

a) positioning a gas permeable, bonded particulate casting mold in a container proximate an open bottom end thereof, said mold having a mold cavity and a melt inlet disposed proximate said open bottom end for communicating said mold cavity to an underlying source of the melt, b) forming a first mass of substantially binderless particulates in the container about the mold remote from said open bottom end, c) forming a second supportive mass of bonded particulates in the container about the mold beneath said first mass proximate said open bottom end, including interlocking said second mass between said container and said mold, whereby said second mass supports said mold and said first mass in said container, d) relatively moving the container and the source to engage the melt inlet and the source, and e) establishing a negative differential pressure between the mold cavity and the source when said melt inlet and said source are engaged sufficient to urge the melt upwardly through said melt inlet into said mold cavity.

* * * * *

UNITED STATES PATENT AND TRADEMARK OFFICE

CERTIFICATE OF CORRECTION

PATENT NO. : 5,062,467

DATED : November 5, 1991

INVENTOR(S) : John G. Kubisch

It is certified that error appears in the above-identified patent and that said Letters Patent is hereby corrected as shown below:

Column 6, line 4, delete "52a" and insert --52c-- therefor.

Signed and Sealed this

Twenty-ninth Day of June, 1993

*Attest:*

*Attesting Officer*

Michael K. Kirk

MICHAEL K. KIRK

*Acting Commissioner of Patents and Trademarks*